United States Patent [19]

Sandler

[11] 4,098,704

[45] Jul. 4, 1978

[54] POLYOXYALKYLENE TETRAHALOPHTHALATE ESTER AS TEXTILE FINISHING AGENT

[75] Inventor: Stanley Robert Sandler, Springfield, Pa.

[73] Assignee: Pennwalt Corporation, Philadelphia, Pa.

[21] Appl. No.: 772,043

[22] Filed: Feb. 25, 1977

[51] Int. Cl.[2] ..... D06M 13/20

[52] U.S. Cl. ..... 252/8.6; 8/115.6; 106/15 FP; 252/8.1; 427/390 D; 560/83

[58] Field of Search ..... 252/8.6, 8.1; 8/115.6; 106/15 FP; 427/390 D; 260/475 P

[56] References Cited

U.S. PATENT DOCUMENTS

| | | | |
|---|---|---|---|
| 3,253,881 | 5/1966 | Donahue | 252/8.8 R |
| 3,285,995 | 11/1966 | Nametz et al. | 260/475 P |
| 3,573,215 | 3/1971 | Nametz et al. | 252/8.1 |
| 3,585,185 | 6/1971 | Levis et al. | 260/475 P |
| 3,624,042 | 11/1971 | Lubowitz et al. | 260/475 P |
| 3,715,383 | 2/1973 | Praetzel et al. | 260/475 P |
| 3,783,017 | 1/1974 | Roth | 106/15 FP |
| 3,896,250 | 7/1975 | Miller | 106/15 FP |
| 3,969,230 | 7/1976 | Scharf | 106/15 FP |

*Primary Examiner*—William E. Schulz

[57] ABSTRACT

A polyoxyalkylene tetrahalophthalate ester composition is provided and the use thereof as a polyester fabric finishing agent to give the fabric durable flame retardancy, and improved water wicking ability wth no added tendency to soil.

11 Claims, No Drawings

POLYOXYALKYLENE TETRAHALOPHTHALATE ESTER AS TEXTILE FINISHING AGENT su

BACKGROUND OF THE INVENTION

1. Field of the Invention

The present invention relates to a polyoxyalkylene tetrahalophthalate ester composition and the method of applying this composition to fabrics, such as 100% polyester, to give the fabrics durable flame retardancy, with no added tendency to soil, and water wicking ability. It also pertains to the finished fabric product with the polyoxyalkylene tetrahalophthalate ester thereon.

2. Description of the Prior Art

Polyoxyalkylene tetrahalophthalates are known in the prior art for flame proofing materials. U.S. Pat. No. 3,775,165 (A) teaches the use of a tetrabromophthalate diester to make polyester fabric flame retardant and to improve the fabric's dyeing properties. A disadvantage of this compound is that it is not water soluble, even with the aid of caustic, and must be applied with an organic solvent such as acetone. This diester also leaves the fabric slightly stiff.

U.S. Pat. Nos. 3,585,185 (B), 3,642,646 (C) and 3,929,866 (D) describe polyoxyalkylene tetrabromophthalates useful for flameproofing polyurethanes. Since polyester fabric differs chemically and physically from polyurethane, polyester would not be expected to respond to treatment in the same manner as polyurethane. However, in tests to evaluate the prior art compounds as finishing agents on polyester fabric the following disadvantages were noted (also see TABLE II). References (A), (B) and (D) were not water soluble even with the aid of caustic and had to be applied to polyester fabric from acetone. Compounds of reference (C) which contain an excess of unreacted polyoxyethylene glycol (Carbowax 400), in most cases, gave poor durability; the greater the excess of Carbowax 400 in (C), the less bromine was retained; and as a result of the higher add-ons required the fabric was more tacky.

U.S. Pat. No. 3,624,042 (E) describes a composition of polyoxyalkylene tetrabromophthalate that is used as a binder in propellant compositions. It was observed that this compound (E) was not soluble in water even when caustic was added and required a large amount of the composition to be added to the polyester fabric. The fabric became very tacky and turned yellow on curing.

SUMMARY OF THE INVENTION

The present invention is directed to a polyoxyalkylene tetrahalophthalate composition that can be readily applied from water having the structure:

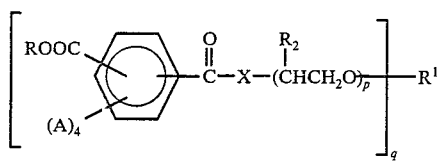

(I)

wherein (a) the ring can have all possible isomeric arrangements;

(b) R is selected from the group consisting of hydrogen, an alkyl or substituted alkyl of 1 to 10 carbons, hydroxyalkyl of 2 to 10 carbons, and polyhydroxyalkyl of 3 to 10 carbons;

(c) $R^1$ is selected from the group consisting of hydrogen, an alkyl or substituted alkyl of 1 to 12 carbons,

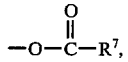

where $R^7$ is an alkyl of 1 to 18 carbons, a polyhydroxyalkyl of 3 to 12 carbons,

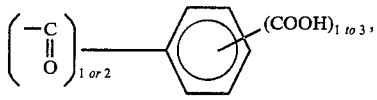

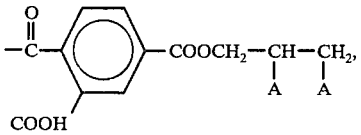

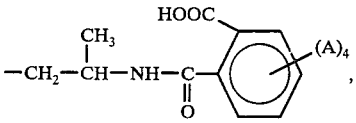

(all isomers)

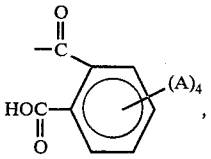

(all isomers)

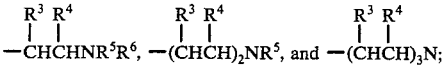

(d) $R^2$ is independently selected from the class consisting of H and $CH_3$—;

(e) $R^3$, $R^4$, $R^5$, and $R^6$ are independently selected from the class consisting of H and an alkyl of 1 to 18 carbons;

(f) $p$ is an integer of 4 to 50;

(g) $q$ is an integer of 1 to 6;

(h) X is selected from O or NH; and (i) A is selected from Cl or Br.

When this composition is applied to the 100% polyester fabric, the finished fabric is not only flame resistant but also has little tendency to soil and has water wicking ability. This composition (I) causes little or no fabric discoloration and may therefor be applied to either white, dyed, or printed polyester fabrics.

DETAILED DESCRIPTION OF THE INVENTION

The polyoxyalkylene tetrahalophthalate composition (I) of this invention can be applied to 100% polyester fabric (i.e., polyethylene terephthalate) either in pure form or in the presence of a solvent. Solvents such as water, a ketone, an alcohol, an organic ester or a halogenated hydrocarbon can be used. When the composition (I) is applied to the polyester fabric in the presence of a solvent, the composition should comprise about 50 to 95 parts by weight of a solvent and about 5 to 50 parts of the composition (I). In certain instances an alkali metal hydroxide such as potassium and sodium hydroxide, ammonium hydroxide and an alkyl amine may be added in a sufficient amount to adjust the pH to the range of 3 to 7, preferably 4 to 5.

The composition (I) of this invention can be applied to polyester fabric in any convenient manner such as from an aqueous pad bath. This bath can be in the form of a solution, an emulsion, or dispersion. The pH of an aqueous fabric-treating bath is generally about 3 to 7. The polyester fabric is passed through the bath to get a sufficient wet pick-up (usually about 70–100%). A bromine add-on will usually preferably be between 1 and 4% in order to meet DOCFF-3-71 specifications. The wet fabric is then dried for about 2–4 minutes at about 110° C and cured for about ½ to 2 minutes at 190° to 200° C. Note that all percentages, unless otherwise stated, are based on the weight of the fabric (owf).

The polyoxyalkylene tetrahalophthalate ester composition (I) of the present invention may be prepared by reacting a tetrahalobenzene dicarboxylic acid or anhydride with a molar equivalent of a polyoxyalkylene glycol or its monosubstituted derivative. The tetrahalobenzene dicarboxylic acids or anhydrides used as starting materials in preparing the compound of this invention are either the tetrabromophthalic acid or anhydride or the tetrabromoisophthalic and tetrabromoterephthalic acids or anhydrides isomers. Tetrachlorophthalic acid and its isomers can also be used for making the analogous chlorinated compounds of the present invention.

Representative polyoxyalkylene derivatives useful as starting materials in preparing the compound of this invention are as follows:

1. Polyoxyethylene glycols, $HO(CH_2CH_2O)_nH$. These glycols are sold under the Trademarks Carbowax and Polyglycol E with a number as part of the mark, such as: Carbowax 400, Carbowax 600, or Polyglycol E-2000. The number after the Trademark denotes the average molecular weight.

2. Polyoxyethylene methyl alcohols, $HO(CH_2CH_2O)_nCH_3$. These derivatives are sold under the Trademark Methoxy Carbowax with a number as part of the mark, such as Methoxy Carbowax 350. The number after the Trademark denotes the average molecular weight.

3. Polyoxyethylene alcohols, $HO(CH_2CH_2O)_nR$. These derivatives are made by the reaction of either ethylene oxide or the appropriate polyoxyethylene glycol with proton reactive reagents such as carboxylic acid chlorides, phosphoryl chlorides, carboxylic acids or acid anhydrides, isocyanates, etc.

4. Polyoxyalkylene glycols $$H\text{-}(OCH_2CH_2)_n\text{-}(OCH(CH_3)\text{-}CH_2)_m\text{-}(OCH_2CH_2)_o\text{-}OH$$

where *n, m,* and *o* are integers, the sum of which results in molecular weights ranging from 150–2000, preferably 150 to 1000. These are mixed polyoxyethylene/polyoxypropylene glycols such as those available from BASF Wyandotte under the Trade name Pluracol and Pluronics.

5. Polyoxyalkylated polyols. These derivatives are derived by reacting ethylene oxide and/or propylene oxide with polyols. Straight and branched-chain polyols, sugars, and starches, are included in this class of compounds.

6. Polyoxyethylated fatty acids. These derivatives are prepared by the reaction of ethylene-oxide with fats or fatty acids to give, for example, polyoxyethylene fatty glycerides.

7. Polyoxyethylated amines. These derivatives are prepared by the reaction of ethylene oxide with fatty amines or alkyl amines.

8. Polyoxypropylene amines, for example, $$NH_2CH(CH_3)\text{-}CH_2(OCH_2\text{-}CH(CH_3))_xNH_2$$

These derivatives are sold under the Trademark Jeffamines by Jefferson Chemical Co. with a letter and number as part of the mark, such as Jeffamine D-400. The letter D denotes the compound has two primary amine groups per molecule (T would denote three amino groups per molecule) and the number denotes the average molecular weight.

Representative compounds of this invention are as follows (where A is Br or Cl):

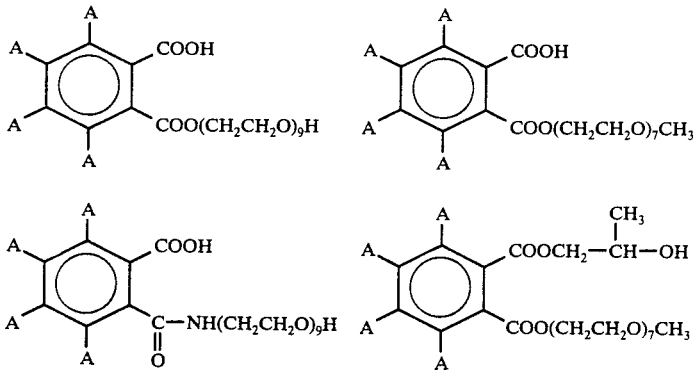

-continued
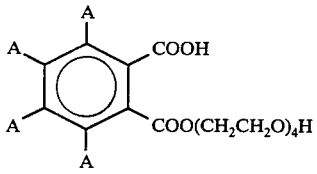
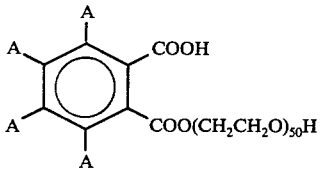
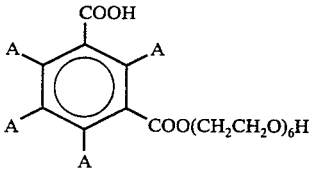
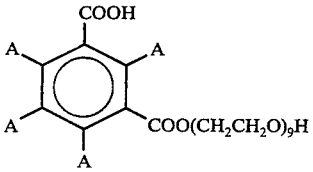
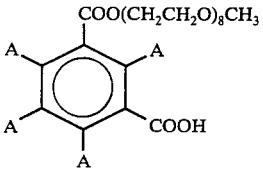
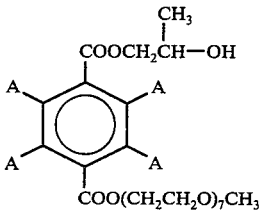
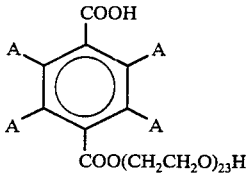
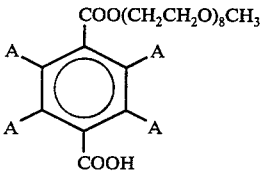
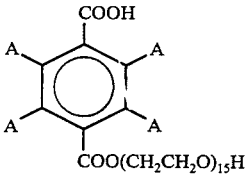
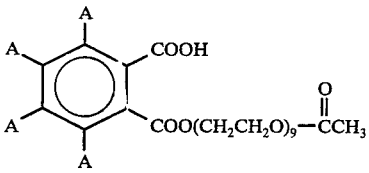
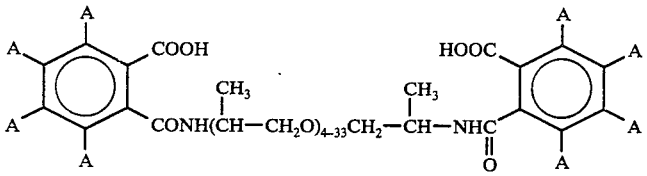
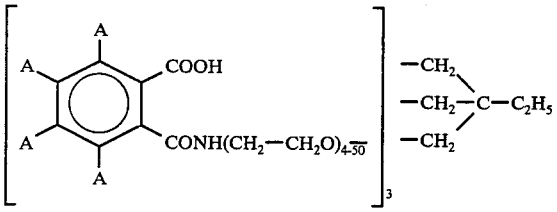
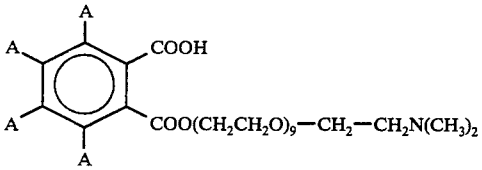

-continued
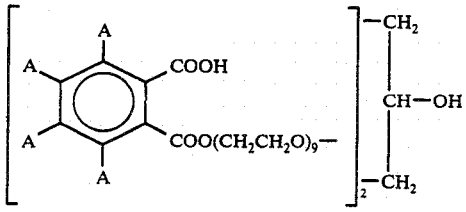
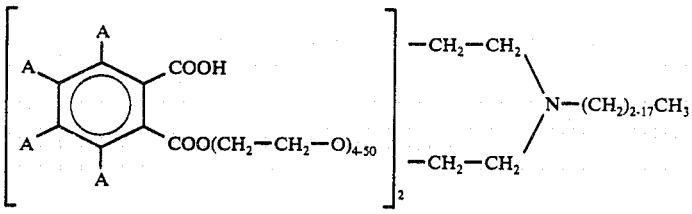
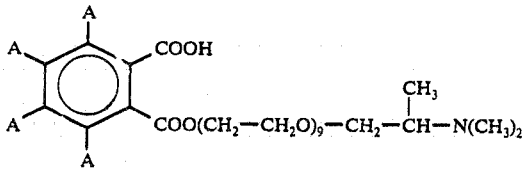
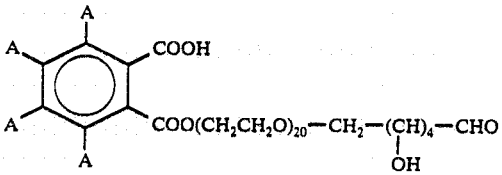
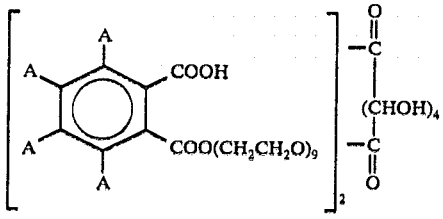
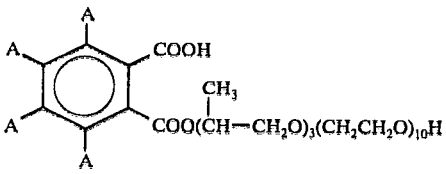
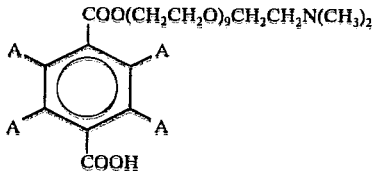
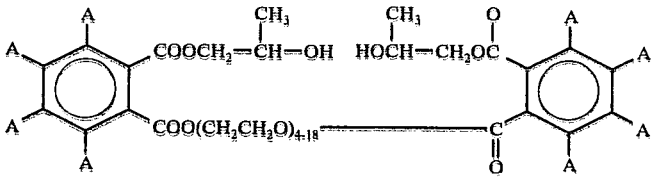
0

-continued

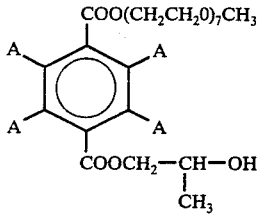

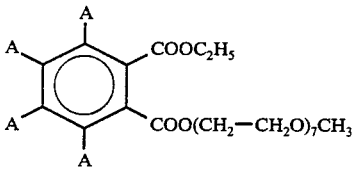

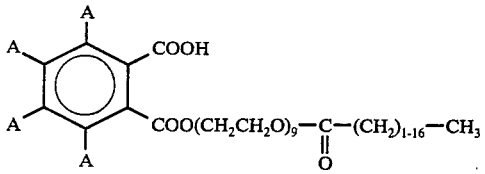

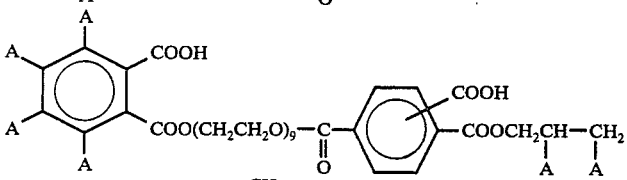

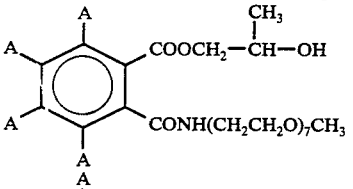

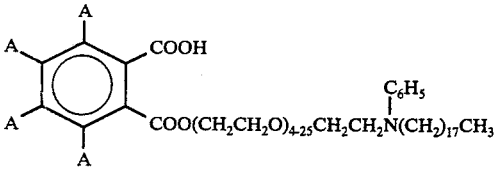

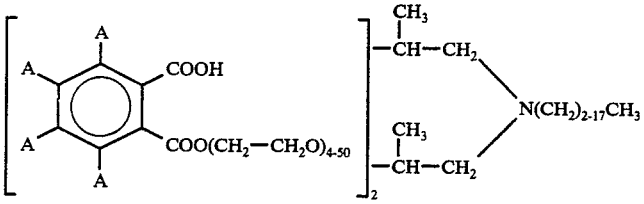

The preferred polyoxyalkylene tetrahalobenzene carboxylate esters of this invention are those prepared by reacting the acid or anhydride with a polyoxyethylene glycol or its derivative having a molecular weight from about 200 to 1000. Examples of the preferred compounds of this invention are the polyoxyethylene tetrahalophthalates as follows:

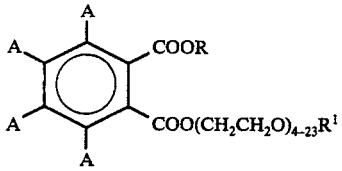

where R is H or $-CH_2-\underset{\underset{CH_3}{|}}{CH}-OH$
$R^1$ is H or $CH_3$
A is Br or Cl -continued

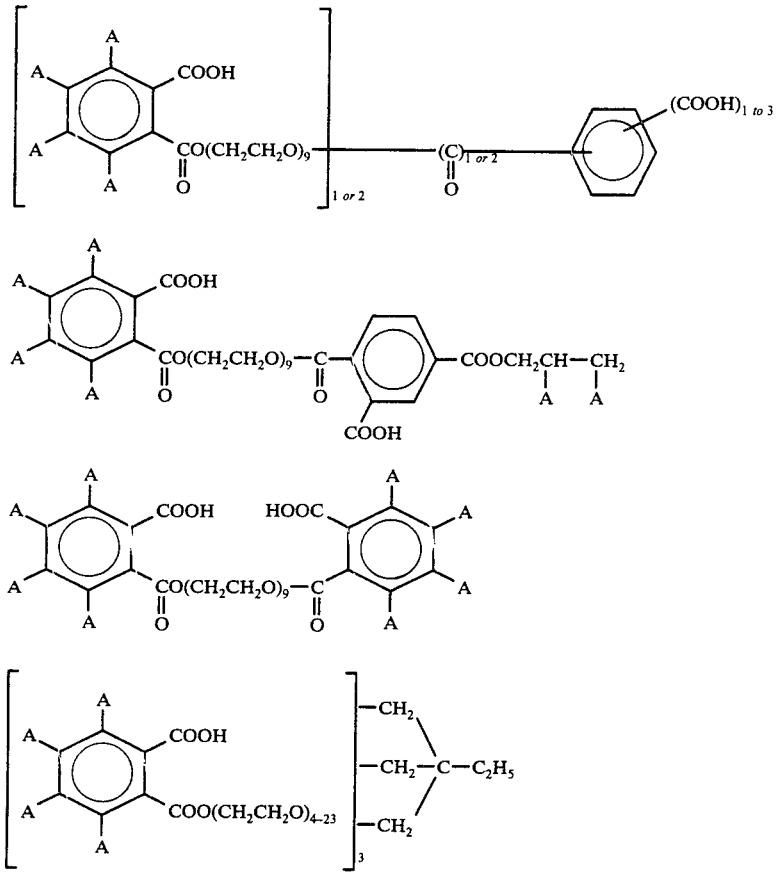

The composition (I) of this invention is a clear, almost colorless and odorless viscous liquid. This composition is prepared in relatively pure form without side reactions or excess reagents remaining and has a halogen (bromine or chlorine) content of preferably about 10 to 50 percent. This composition is normally soluble in acetone, toluene, and perchloroethylene and is preferably either soluble, self-emulsifiable, or easily dispersible in water by the aid of cautstic or with the use of 0.01 to 3 percent of a stabilizing surfactant. Some typical surfactants include alkyl benzene metal sulfonates (such as Alcolac's Siponate DS-10 which is dodecyl benzene sulfonate), polyoxyethylene ethers (such as Wyandotte's Pluronic P68, L121, etc.), polyoxyethylene or polyoxypropylene derivatives of fatty acid esters of glycerol or other polyols (ICI's Span-Tweens) and polyoxyethylene derivatives of alkyl phenols (Rohm and Haas's Triton X-100). The alkyl benzene metal sulfonates alone or a mixture with nonionic surfactants is preferred.

The treated polyester fabric is evaluated for soil release (or stain removal) by visual observation using Test Method 130-1974 as described in the Technical Manual of the American Association for Textile Chemists and Colorists (AATCC), Howes Publishing Co., 44 E 23rd Street, New York, with overhead lighting arranged as described in the test procedure. The fabrics are stained with Nujol according to the test method and additionally with butter, Wesson Oil, and mustard as in the Sears Test TP-l-4; then they are washed according to Test Method 130-1974, placed on a black table top in front of a viewing board having "standard" specimens, and rated according to the criteria shown in the following Table:

TABLE 1

| Rating | Appearance |
|---|---|
| 5 | negligible or no staining (excellent cleanability) |
| 4 | slightly stained (good cleanability) |
| 3 | noticeably stained (fair cleanability) |
| 2 | considerably stained (poor cleanability) |
| 1 | heavily stained (very poor cleanability) |

The treated fabrics are evaluated for water absorbency by AATCC Test Method 79-1975.

The flame retardancy of the treated fabrics is evaluated according to DOC FF-3-71 (Federal Register, Vol. 40, No. 250, pp 59903-59917, Tuesday, December 30, 1975). Samples were laundered and dried according to AATCC Test Method 124-1969. Samples passing this test have an average char length of not more than 7.0 inches with no individual specimen burning 10.0 inches. Samples having a residual flame time greater than 10 seconds fail this test.

The intent of the following Examples is to illustrate the present invention and not to be a limitation thereof.

EXAMPLE 1

To 92.8 g (0.2 mole) of tetrabromophthalic anhydride is added all at once 80 g (0.2 mole) of Carbowax 400 and the mixture heated to 120°-130° C for 2.5 hours. The desired product is isolated in essentially quantitative yield as a clear yellow viscous liquid. Calcd. Mol. Wt., 864; found 865. Calcd. % Br, 371; found, 38.5. The analytical data are consistent with the assigned structure:

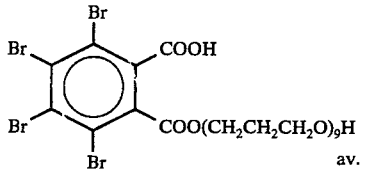

EXAMPLE 2

To 240 g (0.24 mole) of the compound of Example 1 is added 45.3 g (0.24 mole) of trimellitic anhydride and heated at 155° C under nitrogen for about 7 hours. The infrared spectrum indicated the completion of the reaction by the substantial disappearance of the anhydride absorption band at 5.65. The product was isolated in essentially quantitative yield. Anal. Calcd.: %Br, 30.3%; Mol. Wt., 1056; neutralization equivalent, 352; Found: %Br, 29.4; Mol. Wt., 1014; neutralization equivalent, 351. The spectral data was consistent with the structure:

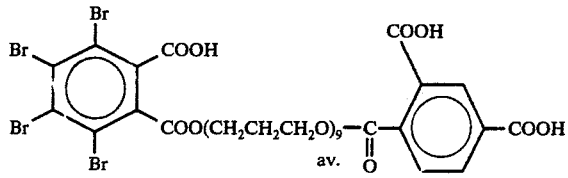

EXAMPLE 3

To 156.3g (0.18 mole) of the compound of Example 1 is added 70.9 g (0.18 mole) 2,3-dibromopropyl trimellitate. The mixture is heated at 130°-140° C for 6 hours with stirring to give the product as a brown opaque oil. Isolation afforded the product in essentially quantitative yield and the analysis is consistent with the structure being:

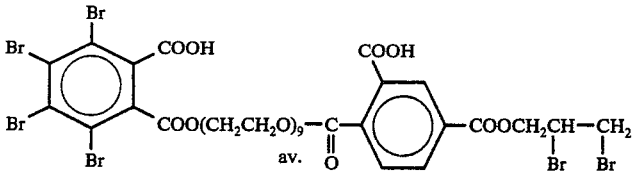

(and isomers)

Examples 4 to 9

(The following preparations were carried out as in Example 1 using the reactants set forth below.)

| Example No. | Tetrabromophthalic Anhydride | Hydroxy Compound | Product Structure |
|---|---|---|---|
| 4 | 1.0 mole | $HOCH_2CH_2OCH_2CH_2OH$ 1.0 mole | 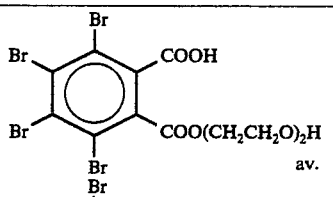  |
| 5 | 1.0 mole | $HO(CH_2CH_2O)_4H$ (Carbowax 200) 1.0 mole | 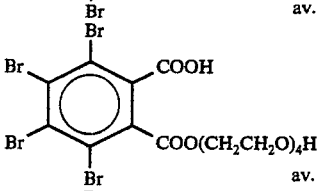  |
| 6 | 1.0 mole | $HO(CH_2CH_2O)_{13}H$ (Carbowax 600) 1.0 mole | 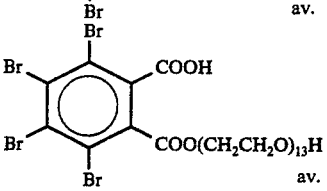  |
| 7 | 1.0 mole | $HO(CH_2CH_2O)_{23}H$ (Carbowax 1000) 1.0 mole | 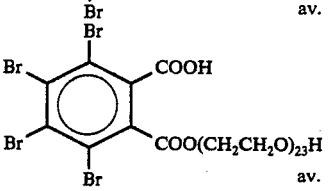  |
| 8 | 1.0 mole | $HO(CH_2CH_2O)_{45}H$ (Polyglycol E-2000) 1.0 mole | 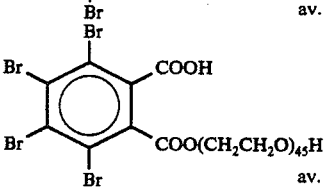  |

Examples 4 to 9-continued (The following preparations were carried out as in Example 1 using the reactants set forth below.)

| Example No. | Tetrabromophthalic Anhydride | Hydroxy Compound | Product Structure |
|---|---|---|---|
| 9 | 2.0 mole | $HO(CH_2CH_2O)_9H$ (Carbowax 400) 1.0 mole | 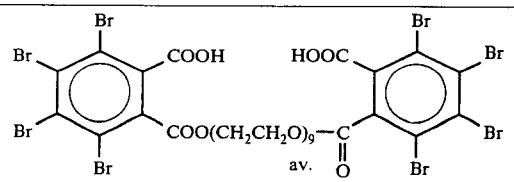 |

EXAMPLE 10

To 1,392 g (3.0 moles) of tetrabromophthalic anhydride is added 1,050 g (3.0 moles) of Methoxy Carbowax 350 in the presence of 22.0 g of sodium acetate. The mixture is heated at 90° C for 8 hours in a nitrogen atmosphere. The reaction mixture is filtered hot to remove the sodium acetate. The analytical data are consistent with the assigned structure:

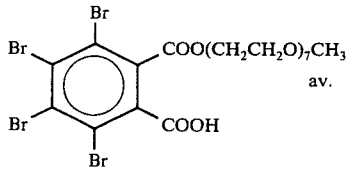

TABLE II

Flame Retardancy-Soil Release and Water Wicking Results of Prior Art References and Examples 1 - 10 Using 100% Undyed Broadcloth Polyester 3.1 oz/yd.[2]

| Prior Art References | Compound or Example | % Solids Add-on (owf) | Calculated % Br (owf) | Solvent or Application | Flame Retardancy (char length in inches) 50 Wash | Soil Release[d] 5 Wash | Soil Release[d] 10 Wash | Water Wicking Seconds[b] 5 Wash |
|---|---|---|---|---|---|---|---|---|
| | Fabric Blank | — | — | — | BEL[a] | 2.0 | 2.1 | 25.5 |
| A | 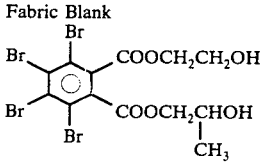 | 7.3 | 4.0 | Acetone | 2.7 | 2.8 | 2.0 | 5.3 |
| B | 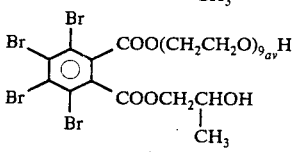 | 10.8 | 3.7 | Acetone | 3.3 | 2.5 | 2.4 | 3.3 |
| C | 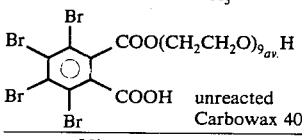 unreacted Carbowax 400 | | | | | | | |
| | 5% 95% | 43.8 | 1.5 | Water | 3.1 | 2.5 | 2.5 | 6.3 |
| | 15% 85% | 27.1 | 2.8 | ↓ | 2.7 | 2.5 | 2.6 | 11.3 |
| | 40% 60% | 14.1 | 3.8 | ↓ | 3.3 | 2.8 | 2.6 | 3.3 |
| D | 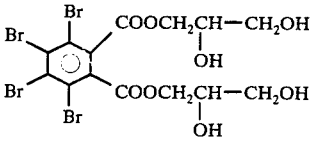 | 9.7 | 4.9 | Acetone | 2.8 | 2.0 | 1.9 | 3.0 |
| E | 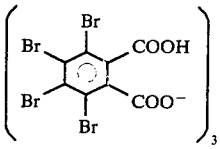 Triol (polyoxy propylene)$_3$[c] where n=8-75 when m=3 | 16.3 | 2.6 | Acetone | 2.8 | 1.9 | 2.4 | 2.7 |
| | Example 1 | 9.2 | 3.3 | Acetone | 3.2 | 2.5 | 2.5 | 3.0 |
| | Example 1 | 16.2 | 5.9 | Acetone | 3.5 | 2.5 | 2.3 | 3.5 |
| | Example 1 | 7.2 | 2.8 | water[e] | 3.7 | 2.6 | 2.9 | 5.7 |
| | Example 2 | 7.3 | 2.8 | acetone | 2.6 | 2.4 | 2.1 | 4.5 |
| | Example 3 | 8.1 | 3.1 | ↓ | 3.4 | 2.8 | 2.1 | — |
| | Example 4 | 6.1 | 3.4 | ↓ | 3.1 | 3.3 | 2.3 | 65.3 |
| | Example 5 | 7.1 | 3.5 | ↓ | 2.7 | 2.8 | 2.0 | 6.6 |
| | Example 6 | 9.0 | 2.8 | water | 2.8 | 2.8 | 2.4 | 12.3 |
| | Example 7 | 10.5 | 2.3 | water[e] | 3.2 | 3.3 | 2.8 | 4.5 |

TABLE II-continued

Flame Retardancy-Soil Release and Water Wicking Results of Prior Art References and Examples 1 – 10 Using 100% Undyed Broadcloth Polyester 3.1 oz/yd.[2]

| Prior Art References | Compound or Example | % Solids Add-on (owf) | Calculated % Br (owf) | Solvent or Application | Flame Retardancy (char length in inches) 50 Wash | Soil Release[d] 5 Wash | Soil Release[d] 10 Wash | Water Wicking Seconds[b] 5 Wash |
|---|---|---|---|---|---|---|---|---|
| | Example 8 | 21.1 | 2.7 | water | 2.5 | 2.6 | 2.5 | 9.0 |
| | Example 9 | 6.6 | 3.1 | acetone | 2.4 | 2.8 | 2.5 | 7.0 |
| | Example 10 | 9.0 | 4.0 | water | 2.8 | 2.5 | 2.4 | 4.0 |
| | Example 10 | 10.0 | 3.4 | water | 2.7 | 3.1 | 2.6 | 4.0 |

[a]BEL signifies Burns Entire Length (Unacceptable)
[b]The lower the number, the better it works.
[c]Triol starting material obtained from Dow Chemical Co. and described as Voranol (P 4701) - mol. wt. 4830, hydroxyl number 34.7, equivalent wt. 1610
[d]The higher the number, the better it releases soil.
[e]Adjusted to pH 7 with ammonium hydroxide.

EXAMPLE 11

To 96.4 g (0.2 mole) of tetrabromoterephthalic acid is added all at once 160 g (0.2 mole) of Carbowax 400 and 300 g toluene containing 1.0 g P-toluene sulfonic acid. The mixture is heated to reflux until 3.6 g (0.2 mole) water was collected. The toluene is removed under reduced pressure to give a clear viscous liquid in essentially quantitative yield. The product

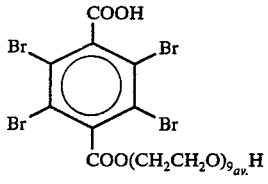

gives flame retardant, soil release, and wicking results similar to that obtained for Example 1.

EXAMPLE 12

To 86.4 g (0.1 mole) of the compound of Example 1 is added all at once 21.8 g (0.1 mole) pyromelltiic dianhydride and the mixture heated to 120°-130° C for 2.5 hours to give the desired product. Water, 1.8 g (0.1 mole), is added to open the remaining anhydride group and the analytical data are consistent with the assigned structure:

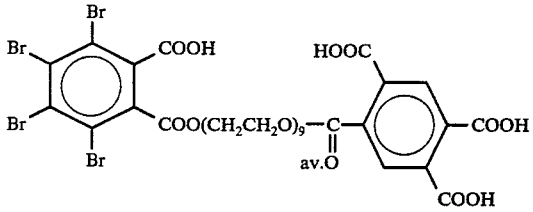

The product gives flame retardant, soil release, and wicking results similar to that obtained for Example 2.

EXAMPLE 13

To 86.4 g (0.1 mole) of the compound of Example 1 is added all at once 10.9 g (00.05 mole) of pyromellitic dianhydride and the mixture heated to 120°-130° C for 2.5 hours to give the desired product. The analytical data are consistent with the assigned structure:

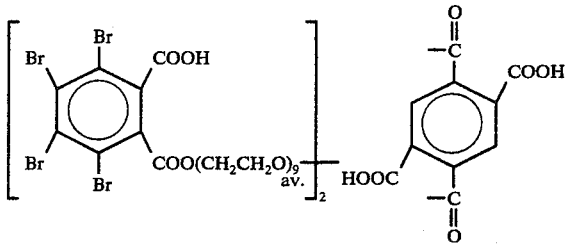

(and isomers)

The product gives flame retardant, soil release, and wicking results similar to that obtained for Example 2.

EXAMPLE 14

To 86.4 g (0.1 mole) of the compound of Example 1 is added all at once 21.8 g (0.1 mole) of phthalic anhydride and the mixture heated to 120°-130° C for 2.5 hours to give the desired product. The analytical data are consisten with the assigned structure:

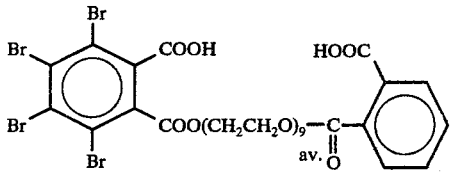

The product gives flame retardant, soil release, and wicking results similar to that obtained for Example 2.

EXAMPLE 15

To 139.2 g (0.3 mole) of tetrabromophthalic anhydride is added all at once 122.9 g (0.1 mole) polyoxyethylated trimethylol propane of molecular weight 1229 and the mixture heated to 120°-130° C for 2.5 hours to give the desired product. The analytical data are consistent with the assigned structure:

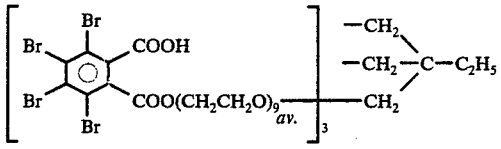

The product gives flame retardant, soil release, and wicking results similar to that obtained for example 7.

EXAMPLE 16

To 139.2 g (0.3 mole) of tetrabromophthalic anhydride is added all at once 156.8 g (0.1 mole) polyoxypropylated trimethylol propane of molecular weight 1568 and the mixture heated to 120°-130° C for 2.5 hours to give the desired product. The analytical data are consistent with the assigned structure:

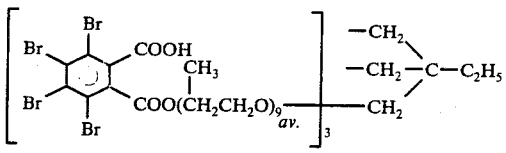

The product gives flame retardant, soil release, and wicking when applied to polyester.

EXAMPLE 17

To the composition of Example 10 (3.0 moles) are added 348.0 g (6.0 moles) of propylene oxide and 2.0 liters of toluene. The mixture is heated at 60°-100° C. The solvent and residual propylene oxide are removed to give the product in almost quantitative yield. The analytical data are consistent with the assigned structure:

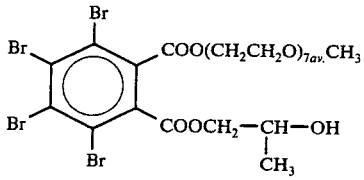

EXAMPLE 18

To 93.1 grams of the composition of Example 17 is added and mixed thoroughly a solution of 1.7 grams of dodecylbenzene sulfonate in 5.2 grams water. Stable pad baths are prepared by adding 15.0 grams of the above composition mixutre to 85 grams water. Fabric samples are padded using 2 dips and 2 nips with the roll pressures adjusted to give 90-100% wet pick-up. The fabrics are then dried for 7 to 9 minutes (or until dry) at 100° C and then thermosolled for 90 seconds at 400° F. Afterwashing is done in washing machine at the hottest water setting using 24 grams of Tide detergent per 18 gallons of water and a 10 minute wash cycle. Fabrics are then rinsed and tumble dried.

Char lengths were measured (DOC FF-3-71) after 25 and 50 launderings using fabric samples that were restrained by stitching up the middle with a double seam of fire retardant spun polyester thread (Threads, Inc., "Sewkay Flame-Out", size 100/2). Bromine analyses were performed after 1 and 50 launderings.

The fabrics were also evaluated for soil release and water wicking after several launderings. The results are summarized in the Table III below.

TABLE III

| Fabric | Total % Add-on | % Bromine Initial[a] | Water Wicking[b] 5W (secs.) | Soil Release[c] 5W | Soil Release[c] 10W | DOCFF-3-71 Char Length 50W[a b d] |
|---|---|---|---|---|---|---|
| Commercial Fabric, 3.1 oz/yd² | | | | | | inches |
| Undyed Broadcloth | 10 | 4 | 9 | 3 | 3 | 3 |
| | 0 | 0 | 90 | 2 | 2 | BEL |

[a] Approx. 50-60% Br is retained after 50 washes.
[b] The lower the number, the better.
[c] The higher the number, the better.
[d] Average of 5 samples.

EXAMPLE 19

To 284.0 g (1.0 mole) of tetrachlorophthalic anhydride is added 350.0 g (1.0 mole) of Methoxy Carbowax 350 in the presence of 7.0 g of sodium acetate. The mixture is heated at 90° C for 8 hours in a nitrogen atmosphere. The reaction mixture is filtered hot to remove sodium acetate to give the expected product in nearly quantitative yield. The analytical data are consistent with the assigned structure:

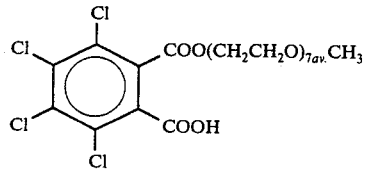

Application of the above compound in an aqueous solution to polyester fabric as described in Example 18 impart flame retardancy.

EXAMPLE 20

To 634.0 g (1.0 mole) of the composition of Example 19 is added 116 g (2.0 moles) of propylene oxide in 200 ml of toluene. The reaction mixture is heated from 60°-100° C for 3-5 hours, and then concentrated to give the product in nearly quantitative yield. The analytical data are consistent with the assigned structure:

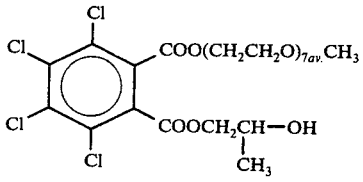

Application of the above compound in an aqueous solution to polyester fabric as described in Example 18 imparts flame retardancy.

EXAMPLE 21

To 284.0 g (1.0 mole) of tetrachlorophthalic anhydride is added 200.0 g (1.0 mole) of Carbowax 200 in the presence of 7.0 g of sodium acetate. The mixture is heated at 90° C for 8 hours in a nitrogen atmosphere. The reaction mixture is filtered hot to remove sodium acetate to generate the expected product in nearly quantitative yield. The analytical data are consistent with the assigned structure:

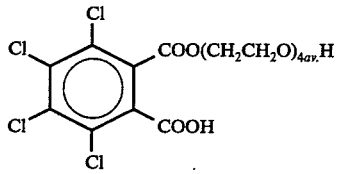

Application of the above compound in an aqueous solution to polyester fabric as described in Example 18 imparts flame retardancy.

EXAMPLE 22

To 484.0 g (1.0 mole) of the product of Example 21 is added 116.0 g (2.0 mole) of propylene oxide in 200 ml of toluene. The reaction mixture is warmed at 60°-100° C for 3-5 hours, and then concentrated to give the product in nearly quantitative yield. The analytical data are consistent with the assigned structure:

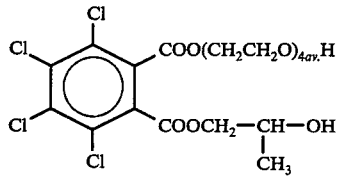

Application of the above compound in an aqueous solution to polyester fabric as described in Example 18 imparts flame retardancy.

EXAMPLE 23

To 284.0 g (1.0 mole) of tetrachlorophthalic anhydride is added 400.0 g (1.0 mole) of Carbowax 400 in the presence of 7.0 g of sodium acetate. The mixture is heated at 90° C for 8 hours in a nitrogen atmosphere. The reaction mixture is filtered hot to remove sodium acetate to generate the expected product in nearly quantitative yield. The analytical data are consistent with the assigned structure:

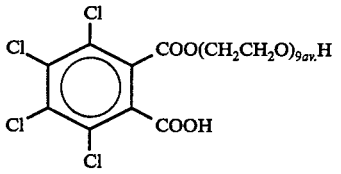

Application of the above compound in an aqueous solution to polyester fabric impart flame retardancy.

EXAMPLE 24

To 46.4 g (0.1 mole) of tetrabromophthalic anhydride is added all at once 44.1 g (0.1 mole) of the polyoxyethylated dimethylamine $[CH_3)_2N(CH_2CH_2O)_9\ H]$ dissolved in 100 ml. of toluene. The mixture was heated at 100°-110° C for 4-5 hours and then concentrated to give the desired product in essentially quantitative yield. The analytical data are consistent with the assigned structure:

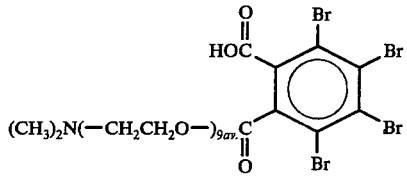

Application of the above compound in an aqueous solution to polyester fabric impart flame retardancy.

EXAMPLE 25

To 92.8 g (0.2 mole) of tetrabromophthalic anhydride is added 80.0 g (0.2 mole) of

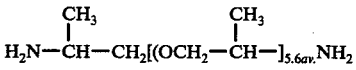

(Jeffamine D-400) and the mixture heated to about 120° C. The final product is obtained in almost quantitative yield. The analytical data are consistent with the assigned structure:

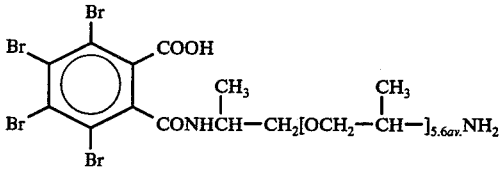

Application of the above compound in an aqueous solution to polyester fabric impart flame retardancy.

What is claimed is:

1. A composition consisting essentially of the formula:

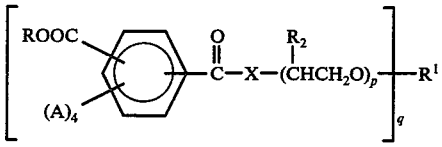

wherein (a) the ring can have all possible isomeric arrangements;

(b) R is selected from the group consisting of hydrogen, an alkyl or substituted alkyl of 1 to 10 carbons, hydroxyalkyl of 2 to 10 carbons, and polyhydroxyalkyl of 3 to 10 carbons;

(c) $R^1$ is selected from the group consisting of an alkyl or substitued alkyl of 1 to 12 carbons,

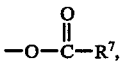

where $R^7$ is an alkyl of 1 to 18 carbons, a polyhydroxyalkyl of 3 to 12 carbons,

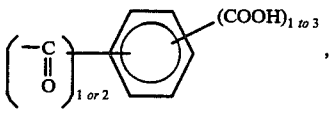

-continued

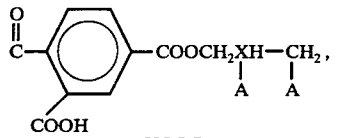

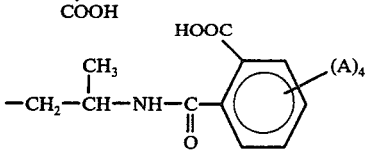

(all isomers)

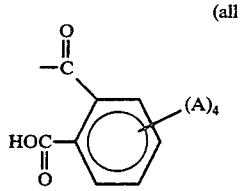

(all isomers)

$-CH(R^3)CH(R^4)NR^5R^6$, $-(CH(R^3)CH(R^4))_2NR^5$, and $-(CH(R^3)CH(R^4))_3N$;

(d) $R^2$ is independently selected from the class consisting of H and $CH_3$—;

(e) $R^3$, $R^4$, $R^5$, and $R^6$ are independently selected from the class consisting of H and an alkyl of 1 to 18 carbons;

(f) $p$ is an integer of 4 to 50;

(g) $q$ is an integer of 1 to 6;

(h) $x$ is selected from O or NH, and (i) A is selected from Cl— or Br—.

2. A composition for treating polyester fabrics to impart flame retardancy, water wicking ability and a low tendency to soil comprising:

(a) 50 to 95 parts by weight of a solvent selected from the group consisting of water, acetone, toluene, and perchloroethylene; and (b) 5 to 50 parts by weight of a polyoxyalkylene tetrahalophthalate having the formula

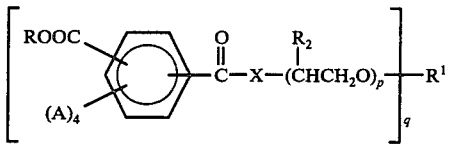

wherein:

(i) the ring can have all possible isomeric arrangements;

(ii) R is selected from the group consisting of hydrogen, an alkyl or substituted alkyl of 1 to 10 carbons, hydroxyalkyl of 2 to 10 carbons and polyhydroxyalkyl of 3 to 10 carbons;

(iii) $R^1$ is selected from the group consisting of hydrogen, an alkyl or substituted alkyl of 1 to 12 carbons, $-O-C(=O)-R^7$, where $R^7$ is an alkyl of 1 to 18 carbons, a polyhydroxyalkyl of 3 to 12 carbons,

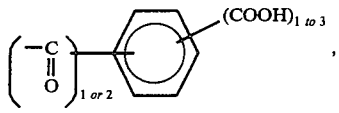

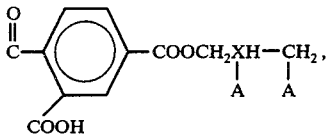

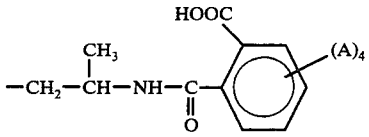

(all isomers)

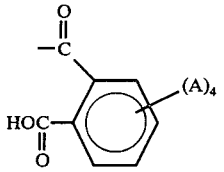

(all isomers)

$-CH(R^3)CH(R^4)NR^5R^6$, $-(CH(R^3)CH(R^4))_2NR^5$, and $-(CH(R^3)CH(R^4))_3N$;

(iv) $R^2$ is independently selected from the class consisting of H and $CH_3$—;

(v) $R^3$, $R^4$, $R^5$, and $R^6$ are independently selected from the class consisting of H and an alkyl of 1 to 18 carbons;

(vi) $p$ is an integer of 4 to 50;

(vii) $q$ is an integer of 1 to 6;

(viii) X is selected from O or NH; and (ix) A is selected from Cl— or Br—;

3. The aqueous composition of claim 2 wherein the composition further comprises a sufficient amount to adjust the pH in the range of 3 to 7 of a compound selected from the group consisting of an alkali metal hydroxide, ammonium hydroxide and alkyl amine.

4. The composition of claim 2 wherein the composition further comprises 0.01 to 3% of a stabilizing surfactant.

5. The composition of claim 2 wherein the polyoxyalkylene tetrahalophthalate is

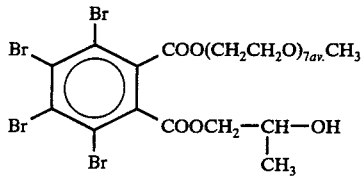

6. A composition of claim 2 wherein the polyoxyalkylene tetrahalophthalate is

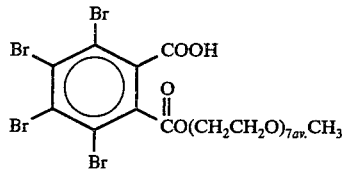

7. The composition of claim 4 wherein the polyoxyalkylene tetrahalophthalate is

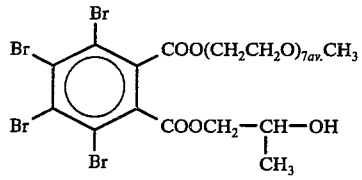

8. A composition of claim 7 wherein the stabilizing surfactant is dodecylbenzene sulfonate.

9. A method of treating a polyester fabric to give the fabric flame retardancy, water wicking ability and a low tendency to soil comprising:

(a) wetting a polyester fabric with a composition containing a polyoxyalkylene tetrahalophthalate to get a sufficient wet pickup;

(b) drying the polyester fabric until the fabric is dry to the touch; and (c) curing the dried fabric in a temperture range of 180° to 210° C;

the polyoxyalkylene tetrahalophthalate, having the structure:

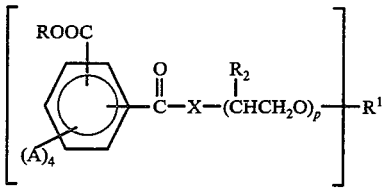

wherein (i) the ring can have all possible isomeric arrangements;

(ii) R is selected from the group consisting of hydrogen, an alkyl or substituted alkyl of 1 to 10 carbons, hydroxyalkyl of 2 to 10 carbons and polyhydroxyalkyl of 3 to 10 carbons.

(iii) $R^1$ is selected from the group consisting of hydrogen, an alkyl or substituted alkyl of 1 to 12 carbons,

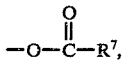

where $R^7$ is an alkyl of 1 to 18 carbons, a polyhydroxyalkyl of 3 to 12 carbons,

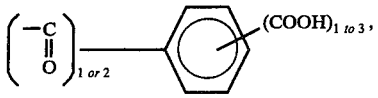

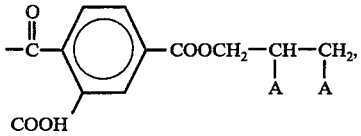

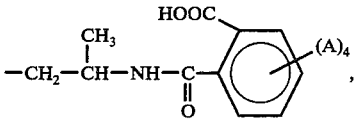

(all isomers)

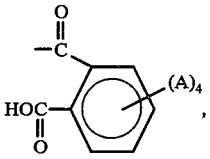

(all isomers)

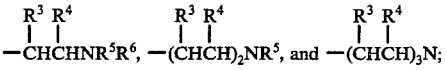

(iv) $R^2$ is independently selected from the class consisting of H and $CH_3$—;

(v) $R^3$, $R^4$, $R^5$, and $R^6$ are independently selected from 9 the class consisting of H and an alkyl of 1 to 18 carbons;

(vi) $p$ is an integer of 4 to 50

(vii) $q$ is an integer of 1 to 6;

(viii) X is selected from O or NH; and (ix) A is selected from Cl— or Br—.

10. The method of treating polyester fabric of claim 9 wherein the composition containing the polyoxyalkylene tetrahalophthalate is

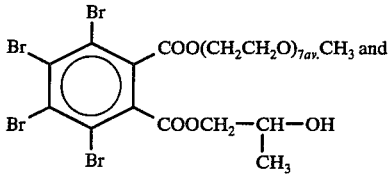

dodecylbenzene sulfonate.

11. A flame retardant, water wicking, low tendency to soil finished polyester fabric consisting essentially of 100% polyester fabric and sufficient polyoxyalkylene tetrahalophthalate ester composition of claim 1 thereon to impart to the fabric at least about 1 to 4% bromine or chlorine.

* * * * *

UNITED STATES PATENT OFFICE

CERTIFICATE OF CORRECTION

Patent No. 4,098,704 Dated July 4, 1978

Inventor(s) Stanley Robert Sandler

It is certified that error appears in the above-identified patent and that said Letters Patent are hereby corrected as shown below:

In lines 1-6, column 23, it reads:

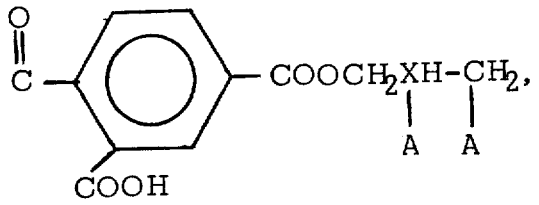

It should read:

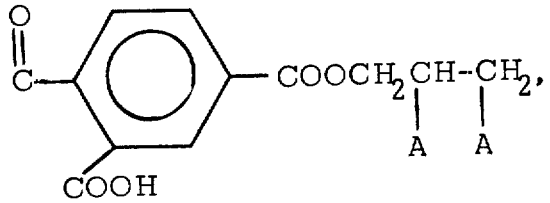

UNITED STATES PATENT OFFICE

CERTIFICATE OF CORRECTION

Patent No. 4,098,704 Dated July 4, 1978

Inventor(s) Stanley Robert Sandler

It is certified that error appears in the above-identified patent and that said Letters Patent are hereby corrected as shown below:

In lines 9-12, column 24, it reads:

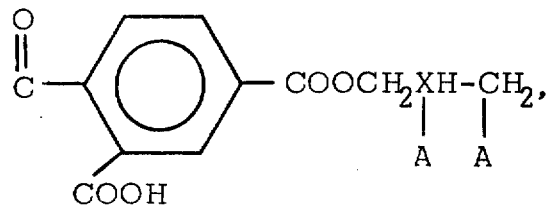

It should read:

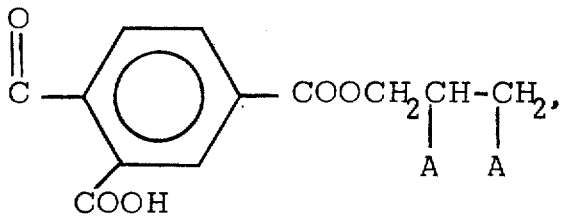

Signed and Sealed this

Eighth Day of May 1979

[SEAL]

Attest:

RUTH C. MASON
Attesting Officer

DONALD W. BANNER
Commissioner of Patents and Trademarks